United States Patent [19]

Naz

[11] 4,096,679

[45] Jun. 27, 1978

[54] SELF-COMPENSATING TWO-PIECE SIDING OR ROOFING SLAT

[76] Inventor: Paul Naz, 20502 Harper, Harper Woods, Mich. 48225

[21] Appl. No.: 801,229

[22] Filed: May 27, 1977

[51] Int. Cl.[2] ..... E04D 1/34

[52] U.S. Cl. ..... 52/551; 52/523; 52/537; 52/545; 52/546

[58] Field of Search ..... 52/551, 521, 523, 525, 52/529, 530, 537, 543, 545, 546, 547, 552

[56] References Cited

U.S. PATENT DOCUMENTS

| | | | |
|---|---|---|---|
| 1,084,120 | 1/1914 | Wemlinger | 52/537 X |
| 2,820,535 | 1/1958 | Hutchison | 52/545 X |
| 2,853,163 | 9/1958 | Lockwood | 52/530 |
| 3,218,772 | 11/1965 | Martin | 52/529 X |
| 3,226,901 | 1/1966 | Harter | 52/530 X |
| 3,269,075 | 8/1966 | Marini et al. | 52/530 X |
| 3,347,009 | 10/1967 | Meddick | 52/551 X |
| 3,473,274 | 10/1969 | Godes | 52/543 X |
| 3,738,076 | 6/1973 | Kessler | 52/551 X |
| 3,757,483 | 9/1973 | Torbett | 52/545 X |

FOREIGN PATENT DOCUMENTS

| | | | |
|---|---|---|---|
| 384,837 | 2/1965 | Switzerland | 52/529 |

*Primary Examiner*—Leslie Braun
*Attorney, Agent, or Firm*—Cullen, Settle, Sloman & Cantor

[57] ABSTRACT

A two-piece interlocking siding or roofing slat assembly for covering a surface of a building. The slat assembly includes a central panel having a lower anchoring configuration and an upper hook-like slide configuration integral therewith. A separate attachement strip is provided for securing the panel to the building surface to be covered so as to prevent "oil canning" which is caused by the expansion and contraction of the exposed surfaces. The attachment strip includes a nailing tab adapted to be fixedly secured to the surface of the building to be covered by fastening elements. The attachment strip further includes a generally C-shaped passage-defining configuration integral with the nailing tab for telescopically receiving the slide configuration therein to secure the upper edge portion of the panel to the attachment strip and a generally U-shaped groove-defining formation which is adapted to receive the anchoring configuration of a later installed panel so that the salt assemblies may be interlocked together one above the other while only the attachment strip is secured to the building surface itself. The nailing tab may be provided with corrugations which serve to compensate for its expansions and contractions caused by aging and/or weather variations and to continually bias the fastening elements to tightly anchor the strip to the surface of the building in a spring-like manner so as to prevent the slats from becoming loose thereby eliminating noise and rattling.

9 Claims, 4 Drawing Figures

SELF-COMPENSATING TWO-PIECE SIDING OR ROOFING SLAT

BACKGROUND OF THE INVENTION

The invention relates to a siding or roofing strip or slat and more particularly to a two-piece interlocking siding or roofing slat assembly including a panel portion and an attachment strip. The panel portion of the slat assembly is adapted to be telescopically received into a channel of the attachment strip to insure that the slat assembly is properly secured while providing room to compensate for expansion and contraction thereby preventing oil canning.

The prior art teaches many different types of interlocking siding sheets for protectively and/or decoratively covering the inside and/or outside walls of a building or trim portions thereof. Similarly, the prior art teaches many different types of interlocking roofing strips or shingles adapted to be secured to the roof portion of a building in a partially overlapping manner, one above the other.

The siding and roofing strips of the prior art which are capable of interlocking are often relatively complex structures which are relatively expensive to make and difficult to install and maintain. Most of the siding or roofing strips of the prior art become loose with age or through exposure to variations in the weather since both of these conditions may result in expansions and contractions of the siding or roofing strips themselves, of the fastening elements used to anchor the strips, and/or the material from which the surface of the building being covered is made.

When roofing or siding strips become loose, they can fall off leaving an unsightly blemish and an uprotected area on the previously covered surface. Water or the like may run under the roofing or siding and into the house causing property damage. Another major problem which has not previously found a commercially acceptable solution is that of noise. When the roofing and/or siding strips become loose, even a gentle breeze may cause a whistling or rattling of the strips much the annoyance of the inhabitants of the building.

None of the roofing and/or siding strips of the prior art, which are commercially feasible when cost considerations are taken into account, provide means to prevent the strips from becoming loose and none provide means whereby the strips may automatically compensate for expansions and contractions. One solution to this problem was suggested in my co-pending application, U.S. Ser. No. 762,847, entitled SELF-COMPENSATING SIDING OR ROOFING STRIP, which was filed on Jan. 27, 1977, and which is incorporated by reference herein.

The present invention eliminates most of the deficiencies of the prior art and provides a two-piece interlocking siding or roofing slat assembly which is not only capable of mechanically interlocking with previously installed slat assemblies in an overlapping manner one above the other but which self-compensates for expansions and contractions while simultaneously self-biasing the fastening elements to tightly anchor the slat assembly to the surface of the building in a spring-like manner so as to prevent the slat assemblies from coming loose and eliminating noise but also provides additional expansion and contraction compensation means due to the nature of the telescopic interfit between the panel and the attachment strip to insure the elimination of oil canning thereby greatly prolonging the useful life of the slat assemblies.

SUMMARY OF THE INVENTION

The present invention involves a two-piece interlocking slat assembly for use as siding, roofing or the like to cover the inside or outside surface areas of a building. The first element of the interlocking slat assembly of the present invention includes a surface-covering panel which includes a generally L-shaped anchoring configuration integral with a lower edge portion thereof and a generally hook-like slide configuration integral with the opposite edge portion thereof. A separate attachment strip is provided for securing the panel to the building surface so as to prevent "oil canning" caused by expansion and contraction. The attachment strip includes a nailing tab adapted to be fixedly secured to the building surface by fastening elements. The attachment strip further includes a generally C-shaped passage-defining configuration integral with the nailing tab for telescopically receiving the slide configuration therein to secure the upper edge portion of the panel to the attachment strip so as to provide compensation for expansions and contractions. The attachment strip also includes a generally U-shaped groove-defining formation integral with the nailing tab for engagably receiving a portion of anchoring configuration of another panel so that the slat assemblies may be interlocked together one above the other.

The nailing tab of the attachment sheet may include corrugation means have alternate ridge and valley portions adapted to engagably receive fastening elements therethrough for fixedly anchoring the attachment strip to the surface of the building being covered. The corrugation means cooperates with the building surface being covered and with the fastening elements for further automatically compensating for expansion and contraction of the slat assemblies with changing weather conditions and/or with aging and for achieving a spring-type buckle washer effect to self-bias the nailing tab and the fastening elements to maintain a tight fit therebetween so as to prevent the slat assemblies for working loose and eliminating rattling and noise.

The present invention may also include a plurality of apertures provided through the corrugation means for operatively receiving a portion of the fastening elements therethrough for securing the attachment strip to the surface of the building being covered to achieve the self-biasing effect.

The attachment strip of the present invention may be adapted so that the thickness of the corrugated nailing tab is less than the thickness of the panel to facilitate the ability of the corrugation means to compensate for expansions and contractions. Furthermore, in the preferred embodiment of the present invention, the attachment strip is an integrally formed piece of durable, weather resistant plastic material such as vinyl or the like while the panel itself may be a typical prior art aluminum sheet.

The nature of the telescopic fit between the hook-like upper end portion of the panel and the channel-forming means of the separate attachment strip provides an additional means for compensating for expansions and contractions due to aging and exposure to the elements so as to prevent "oil canning" of the panel portions and greatly prolong the useful life of the slat assemblies.

The interlocking slat assemblies of the present invention allow for a tight mechanical interlock with partial overlap of the assemblies one above the other while simultanouesly providing for expansion and contraction compensation to keep the slat assemblies secured to the surface of the building being covered and to prevent loose slat assemblies and eliminate noise and rattling.

Other advantages and meritorous features of the present invention will be more fully understood from the following detailed description of the drawings and the preferred embodiments, the appended claims and the drawings which are described briefly hereinbelow.

DESCRIPTION OF THE PREFERRED EMBODIMENT

Figure 1:
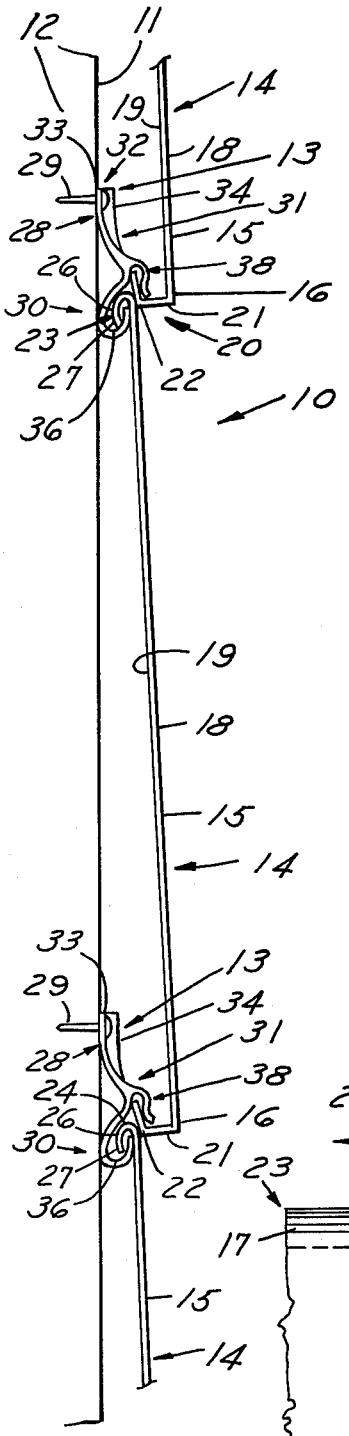
FIG. 1 is a partial side view illustrating the roofing or siding slat assemblies of the present invention as they would be installed to cover a surface such as the side of a building.

FIG. 1 is a fragmentary side view illustrating the roofing or siding slat assemblies 10 of the present invention as they would be installed to cover a surface 11 such as the side of a building 12. Each slat assembly 10 includes a panel 14 and a separate attachment strip 13.

Figure 3:
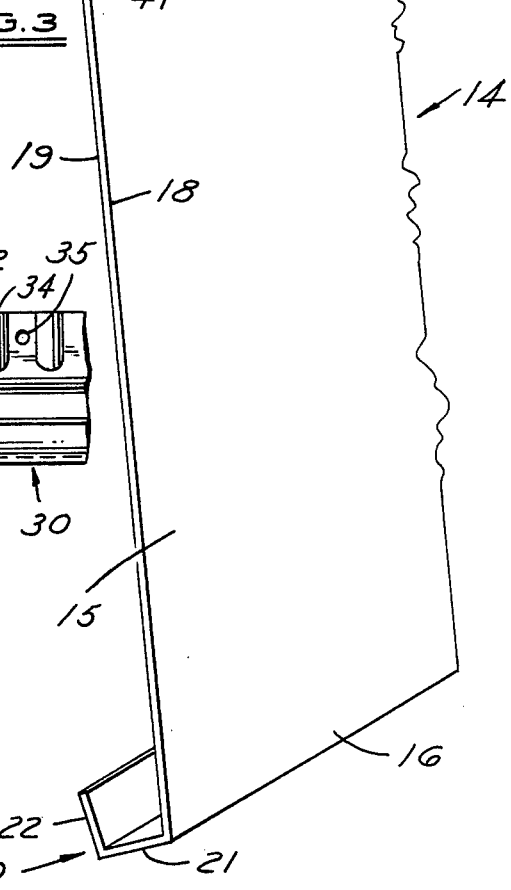
FIG. 3 is a perspective view of the panel portion of the two-piece slat assembly of the present invention.

The panel 14 is shown in FIGS. 1 and 3 and it includes a generally planar central panel portion 15 having a lower edge portion 16, an upper edge portion 17, an exterior surface 18 and an interior surface 19 disposed adjacent the surface 11 of the building 12 to be covered. The interior surface 19 of the central panel portion 15 defines a first generally flat reference plane.

The lower end portion 16 of the panel 14 includes a generally L-shaped anchoring configuration 20 integral with the lower end portion 16 and extending rearwardly therefrom. The arm 21 of the L-shaped anchoring configuration 20 is integral with the lower end portion 16 and is generally perpendicular to the reference plane defined by the interior surface 19 and is disposed outwardly therefrom toward the surface 11 of the wall 12 to be covered. The leg portion 22 of the L-shaped anchoring configuration 20 is integral with the arm portion 21 and generally perpendicular thereto. The leg portion 22 is disposed operatively toward the upper end portion 17 and is generally parallel to the reference plane previously defined. The end portion of the leg 22 is adapted to be received in grooves 38 hereinafter defined for anchoring the lower end 16 of the panel 14 when the slat assemblies 10 of the present invention are installed over the surface 11 of the building 12 in a partially overlapping manner one above the other.

The upper end portion 17 of the panel 14 includes a hook-like slide configuration 23 thereon. The hook-like slide configuration includes a generally U-shaped portion 24 having a first leg 25 integral with the upper end portion 17 and its opposite leg 26 being spaced away from the reference plane and downwardly toward the lower end portion 16. The slide configuration 23 also includes a substantially flattened S-shaped portion 27 integral with the second leg 26 of the U-shaped portion 24 which is disposed generally downwardly toward said L-shaped configuration 20 adjacent the interior surface 19 of the panel 14. In the preferred embodiment, the panel 14 is a single piece of sheet aluminum although any suitable roofing or siding material could be used.

Figure 2:
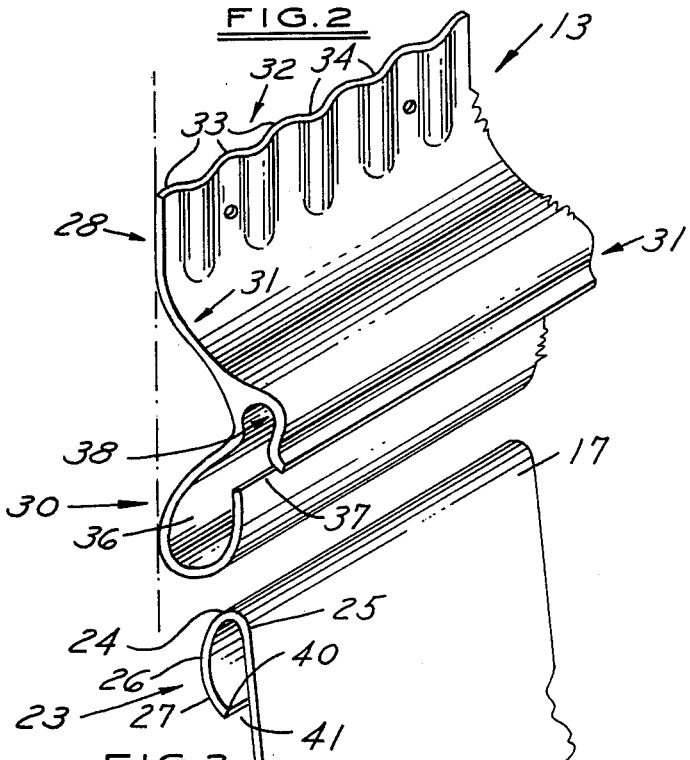
FIG. 2 is a perspective view of the separate attachment strip portion of the two-piece slat assembly of the present invention.

FIGS. 1 and 2 illustrate the separate attachment strip of the present invention. The attachment strip 13 includes a nailing tab 28 adapted to be fixedly secured to the surface 11 of the building 12 as by fastening elements 29, such as nails or the like. Furthermore, the attachment strip 13 includes a generally C-shaped passage-defining configuration 30 integral with said nailing tab 28 and adapted to telescopically receive the hook-like slide configuration 23 of the panel 14 laterally therein so as to secure the upper edge portion 17 of the panel 14 to the separate attachment strip 13 in such a manner so that the fit compensates for expansions and contractions of the panel 14. The attachment strip 13 also includes a generally U-shaped groove defining formation 31 integral with the passage-defining configuration 30 and the nailing tab 28 for engagably receiving the leg 22 of the L-shaped anchoring configuration 20 on the lower end of another panel 14 to be attached to the building so that the siding or roofing slat assemblies are mechanically interlocked together one above the other in a partially overlapping manner with only the attachment strips 13 being physically attached to the surface 11 of the building 12. In the preferred embodiment, the attachment strip 13 is an integrally formed piece of weather-resistant, resilient plastic material such as vinyl or the like although any suitable conventional material could be used.

The nailing strip 28 includes a corrugated portion 32 having alternate ridges 33 and valleys 34 which provide additional compensation for expansions and contractions. The ridges 33 and valleys 34 of the corrugated portion 32 of the nailing tab 28 cooperate with the surfaces of the fastening elements 29 as described in the above-referenced co-pending application to provide a buckle-washer effect to keep the nailing tab 28 firmly secured to the surface 11 of the building 12 to which it is attached by the fastening elements 29. The corrugated portion 32 may be provided with apertures 35 for receiving the fastening elements 29 therethrough, if desired.

The generally C-shaped channel-defining portion 30 is integral with the nailing tab 28 and forms a hollow central channel 36 therein which is adapted to snugly receive the hook-like slide configuration 23 of the panel 14 laterally therein to secure the attachment strip 13 to the panel 14 while preventing longitudinal up and down movement within the channel 36. The fit between the hook-like slide configuration 23 and the similarly configured slot 36 of the C-shaped configuration 30 provides a further means for compensating for expansions and contractions in the panel and aids in preventing "oil canning" thereby increasing the useful life of the siding or roofing slat assemblies.

The open-bight of the C-shaped configuration 30 faces generally toward the interior surface 19 of the panel 14 and is in the form of a lateral slot 37 through which the upper end portion 17 of the panel 14 passes when the hook-like slide configuration 23 is disposed within the channel 36. The attachment strip 13 also includes a groove-defining formation 31 which is integral with the nailing tab 28 and the channel-defining formation 30. The groove-defining formation 31 forms a groove 38 which faces downwardly toward the lower end portion 16 of the panel 14. The formation 31 is spaced away from the interior of the panel 14 so that it is able to operatively engage the leg 22 of the anchoring configuration 20 of another panel 14 to be installed to anchor the lower end 16 of the other panel within the groove 38 so that the slat assemblies are mechanically interlocked as they are installed one above the other in a partially overlapping manner.

Figure 4:
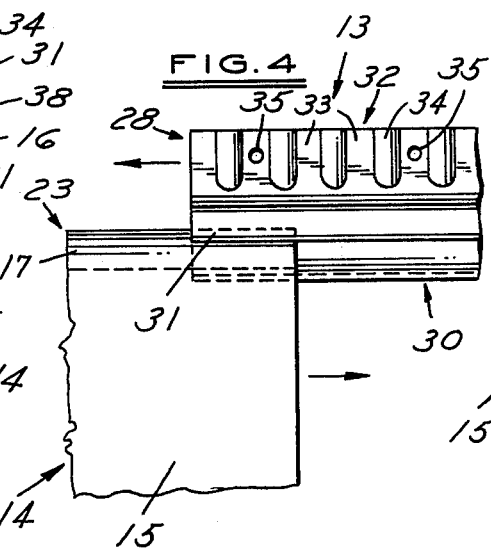
FIG. 4 is a front view of a panel portion as it is telescopically secured to the separate attachment strip of the present invention.

FIG. 4 shows the panel 14 being slidably inserted laterally into the channel 36 of the attachment strip 13 so that they can be telescoped into one another as shown by the arrows in FIG. 4 until the upper end 17 of the panel 14 is enclosed within the channel 36 so as to prevent longitudinal (perpendicular to the axis of slot 36) up and down movement therein. Once the two separate pieces are secured together as shown in FIG. 4, the leg 22 of the anchoring configuration 20 of the panel 14 is inserted within the groove 38 of a previously secured attachment strip 13 so that it is mechanically interlocked therein and then the upper edge portion 17 of the panel 14 together with the attached or secured attached strip 13 is placed against the surface 11 of the building 12 and fastened thereto by means of a fastening element 29 through the corrugated portions 32 to insure a tight self-biasing fit and to provide additional expansion and contraction compensation.

With this detailed description of the specific apparatus used to illustrate the prime embodiment of the present invention and the utilization thereof, it will be obvious to those skilled in the art that various modifications can be made in the slat assembly of the present invention and in the various sizes and shapes of the configurations forming a part thereof without departing from the spirit and scope of the present invention which is limited only by the appended claims.

I claim:

1. An interlocking slat assembly for use as siding, roofing and the like to cover surface areas of buildings comprising:

a surface-covering panel including a generally L-shaped anchoring configuration integral with a lower edge portion thereof and a generally hook-like slide configuration integral with the opposite edge portion thereof; and a separate attachment strip of substantially the same width as said panel for securing said panel to said building surface so as to prevent "oil canning" caused by expansion and contraction, said attachment strip including a nailing tab adapted to be fixedly secured to said building surface by fastening elements, a generally C-shaped passage-defining configuration integral with said nailing tab for laterally telescopically receiving said slide configuration therein to secure the upper edge portion of said panel to said attachment strip so as to provide compensation for expansions and contractions and a generally U-shaped groove-defining formation integral with said nailing tab for engagably receiving a portion of an anchoring configuration therein so as to anchor the lower edge portion of another panel to be attached to said building surface, the anchoring configuration of the panel whose slide configuration is laterally telescopically received in said defined strip passage being anchored in the groove of a previously installed slat assembly for interlocking said slat assemblies together one above the other, said nailing tab including corrugation means having alternative ridge and valley portions perpendicular to the width of said nailing tab for engagably receiving fastening means therethrough for fixedly securing said attachment strip to the surface of said building being covered, said corrugation means cooperating with said building surface being covered and said fastening elements for compensating for expansion and contraction of said strips with changing weather conditions and for achieving a spring-type buckle washer effect for maintaining a tight fit therebetween thereby preventing said slat assembly from working loose and eliminating rattling and the like.

2. The interlocking slat assembly of claim 1 wherein said panel is an integrally formed piece of sheet aluminum and said attachment strip is a single integrally formed piece of relatively strong resilient plastic material.

3. The interlocking slat assembly of claim 1 wherein said corrugation means includes a plurality of apertures therethrough for operatively receiving a portion of said fastening elements therein to facilitate securing said attachment strip to said building surface.

4. The interlocking slat assembly of claim 1 wherein said panel includes interior and exterior surfaces, and upper and lower edge portions, and wherein said interior surface next adjacent said building surface being covered defines a first plane, said generally L-shaped anchoring configuration including an arm portion integral with said lower edge portion and extending generally perpendicular to said first plane away from said interior surface and toward said building surface for spacing said lower edge portion from said building surface being covered and a leg portion integral with said arm portion and disposed upwardly toward said upper edge portion and generally parallel with said first plane, said leg portion being adapted to be receivably anchored in the groove of a previously installed slat assembly for interlocking said slat assemblies together one above the other.

5. The interlocking slat assembly of claim 4 wherein said generally hook-like slide configuration of said panel includes a generally U-shaped portion with one leg being integral with the upper edge portion of said panel and the opposite leg being disposed adjacent the interior surface of said panel and toward said lower edge portion, said hook-like slide configuration further including a substantially flatened, generally S-shaped hook body integral with said opposite leg of said U-shaped portion and disposed toward said lower edge portion, said hook-like slide configuration being telescopically received laterally within said defined passage of said strip so as to be constrained against longitudinal up and down movement therein while allowing for expansion and contraction compensation.

6. The interlocking slat assembly of claim 5 wherein said nailing tab of said attachment strip includes a plurality of ridge and valley portions adapted to receive a fastening element therethrough for securing said attachment strip to said building surface being covered while allowing for expansion and contraction compensation and providing a buckle-washer type attachment effect.

7. The interlocking slat assembly of claim 6 wherein said ridge and valley portions include apertures adapted to receive a portion of said fastening element therethrough to facilitate securing said attachment strip to said building surface.

8. The interlocking slat assembly of claim 6 wherein said generally U-shaped groove-defining formation of said attachment strip is integral with the lower edge portion of said nailing tab and is spaced away from said building surface outwardly of said exterior surface of said panel with said groove disposed downwardly toward said lower edge portion, said downwardly disposed groove being adapted to receive the upwardly disposed leg portion of the anchoring configuration of a later installed panel therein for anchoring the lower end of the later installed panel to prevent longitudinal up and down movement as the upper edge portion of said panel is attached to said building surface by its attachment strip.

9. The interlocking slat assembly of claim 8, wherein said generally C-shaped passage-defining configuration has its upper portion integral with said groove-defining formation and said nailing tab, the closed portion of said passage-defining configuration being disposed adjacent said building surface with the opened slot portion thereof being disposed outwardly from said building surface such that said hook-like slide configuration of said panel is adapted to be telescopically received within said passage to laterally slide therein while being constrained against longitudinal up and down movement, said panel extending out of said slot and downwardly therefrom with the groove of said U-shaped formation being disposed outwardly from the exterior surface of said panel adjacent the upper end portion thereof for engagably receiving the L-shaped configuration of a later installed slat assembly for anchoring the lower end thereof so that said slat assemblies may be mechanically interlocked together one above the other.

* * * * *